US011784433B2

(12) United States Patent
Ruiz Rivas et al.

(10) Patent No.: US 11,784,433 B2
(45) Date of Patent: Oct. 10, 2023

(54) CONNECTOR

(71) Applicant: HEWLETT-PACKARD DEVELOPMENT COMPANY, L.P., Spring, TX (US)

(72) Inventors: Victor Ruiz Rivas, Barcelona (ES); Maria Martinez Heredia, Barcelona (ES); Francesc Melia Sune, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 207 days.

(21) Appl. No.: 17/418,565

(22) PCT Filed: Jul. 4, 2019

(86) PCT No.: PCT/US2019/040661

§ 371 (c)(1),
(2) Date: Jun. 25, 2021

(87) PCT Pub. No.: WO2021/002876

PCT Pub. Date: Jan. 7, 2021

(65) Prior Publication Data

US 2022/0069507 A1 Mar. 3, 2022

(51) Int. Cl.
*H01R 13/453* (2006.01)
*H01R 13/52* (2006.01)

(52) U.S. Cl.
CPC ..... *H01R 13/4536* (2013.01); *H01R 13/5213* (2013.01)

(58) Field of Classification Search
None
See application file for complete search history.

(56) References Cited

U.S. PATENT DOCUMENTS 4,176,897 A 12/1979 Cameron
4,217,019 A * 8/1980 Cameron ..... H01R 13/44 439/138
4,229,616 A 10/1980 Hotchkiss
5,618,204 A * 4/1997 Nix ..... H01R 13/6456 439/271
5,701,232 A 12/1997 Tang et al.
5,716,224 A 2/1998 Masuda
6,004,147 A 12/1999 Don-Yehiya
6,709,274 B2 3/2004 Lazaro, Jr. et al.
7,744,388 B2 6/2010 Lee
(Continued)

FOREIGN PATENT DOCUMENTS

JP H0424275 U 2/1992

*Primary Examiner* — Tho D Ta
(74) *Attorney, Agent, or Firm* — SHOOK, HARDY & BACON L.L.P.

(57) ABSTRACT

A connector comprises a first housing having a connection end to be inserted into an opening of a second connector, the first housing containing a first electrical contact, wherein the connection end comprises a first opening. The connector further comprises a first cover biased towards a closed position in which the first electrical contact is inaccessible via the first opening, wherein the first cover is moved from the closed position to an open position exposing the first electrical contact during insertion of the connection end into the opening of the second connector.

13 Claims, 6 Drawing Sheets

(56) References Cited

U.S. PATENT DOCUMENTS

| | | | |
|---|---|---|---|
| 8,528,857 | B2 | 9/2013 | Hillereau et al. |
| 8,968,014 | B2 | 3/2015 | Russell |
| 9,818,665 | B2 | 11/2017 | Elian et al. |
| 2016/0193785 | A1 | 7/2016 | Bell et al. |

* cited by examiner

CONNECTOR

BACKGROUND

Connectors may enable the connection of two or more electrical contacts to provide an electrical coupling between two or more components. In some cases, a housing may be provided around the electrical contacts for protection.

DETAILED DESCRIPTION

Figure 1A:
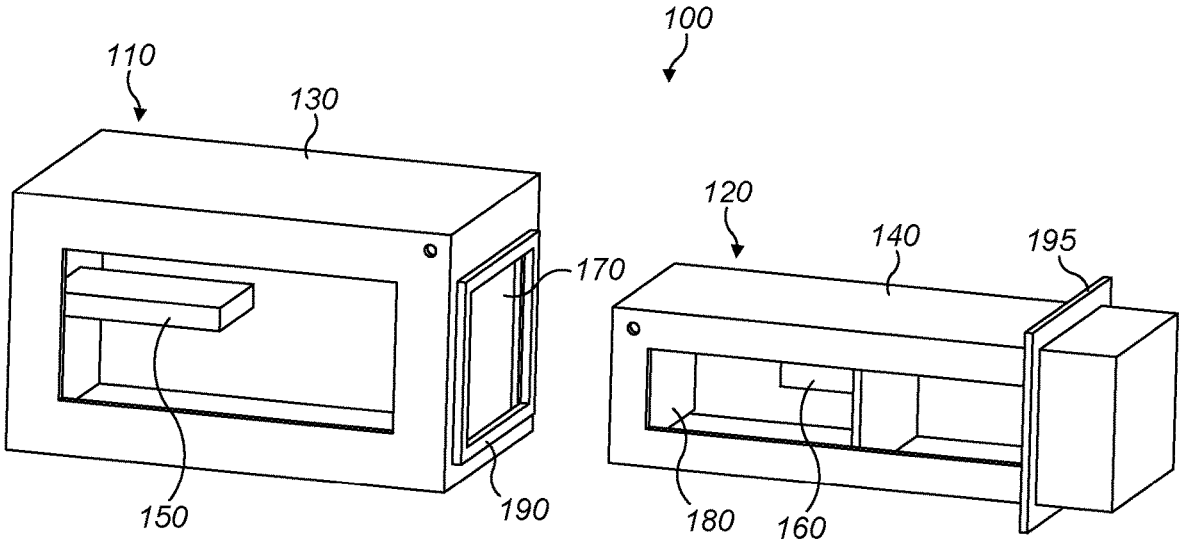
FIG. 1*a* is a schematic diagram showing a connector system according to an example in a disconnected state.

Referring to FIGS. 1*a-e*, there is shown an example of an electrical connection system 100. FIG. 1*a* shows a system 100 comprising a first connector 120 and a second connector 110 for coupling with the first connector 120. The first connector 120 comprises a first housing 140 having an internal cavity and a connection end for insertion into a receiving connector, illustrated here as second connector 110. The connection end includes a first opening, covered by a first cover 180. In an example, the first cover 180 may be a hinged door with a biasing mechanism, which may be a spring, to bias the hinged door towards a closed position to isolate the internal cavity in the first housing 140 from the external environment. Contained within the first housing 140 is a first electrical contact 160. The exterior surface of the first housing 140 is provided with a sealing flange 195 for engaging with a seal on a receiving connector to prevent the ingress of particles within the opening of the receiving connector when the first connector 120 is fully inserted into the receiving connector.

The second connector 110 comprises a second housing 130 having an internal cavity and a second opening at a receiving end for receiving the first connector 120. Covering the opening is a second cover 170. In an example, the second cover 170 may be a hinged door with a biasing mechanism, which may be a spring, to bias the hinged door towards a closed position to isolate the internal cavity in the second housing 130 from the external environment. Contained within the second housing 130 is a second electrical contact 150. Provided on the second housing 130 around the second opening is a seal 190 for engaging with the sealing flange 195 on the first connector 120 when the first connector is inserted within the second opening of the second connector 110.

FIG. 1*a* illustrates first connector 120 and second connector 110 in a disconnected state. In some examples, when in the disconnected state, the first housing 140 and the first cover 180 cooperate to prevent particle ingress into the cavity within the first housing 140, likewise, the second housing 130 and the second cover 180 cooperate to prevent particle ingress into the cavity within the second housing 130. In some examples, the first and/or second connector 120/110 provides an ingress protection level IP6 around the cavity, completely preventing particle ingress when in a disconnected state.

Figure 1B:
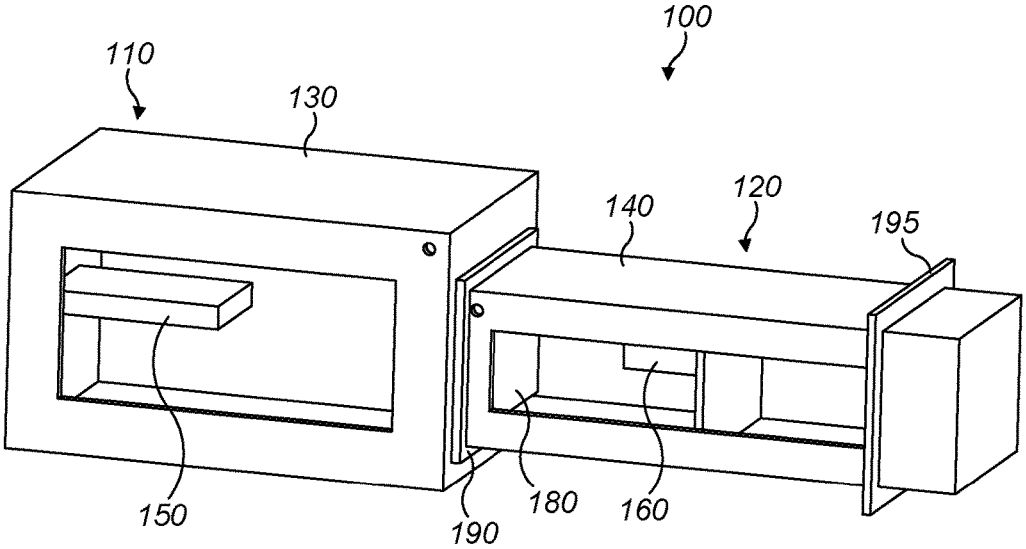
FIG. 1*b* is a schematic diagram showing the connector system of FIG. 1*a* in a first stage of connection according to an example.

FIGS. 1*b-e* illustrate how the first connector 120 may be inserted within the opening of the second connector 110 to couple the first electrical contact 160 with the second electrical contact 150. In an example, the first connector 120 is inserted within the opening of the second connector by linear movement of the first electrical contact 160 relative to the second electrical contact 150. However, other insertion profiles may be used depending on the geometry of the first housing 140 and the second housing 130. FIG. 1*b* illustrates how the connection end of the first housing 140 may be inserted within the second housing 130 via the second opening. In some examples, the connection end of the first housing 140 may be sized to fit flush with at least one of the second opening or an inner surface within the internal cavity in the second housing 130, to provide a sliding fit when coupling the first connector 120 with the second connector 110. This may improve particle ingress protection during the coupling of the two connectors by reducing or minimising the gap between the first housing 140 and the second opening and also help to retain the connection end of the first connector 120 within the second housing 130.

Figure 1C:
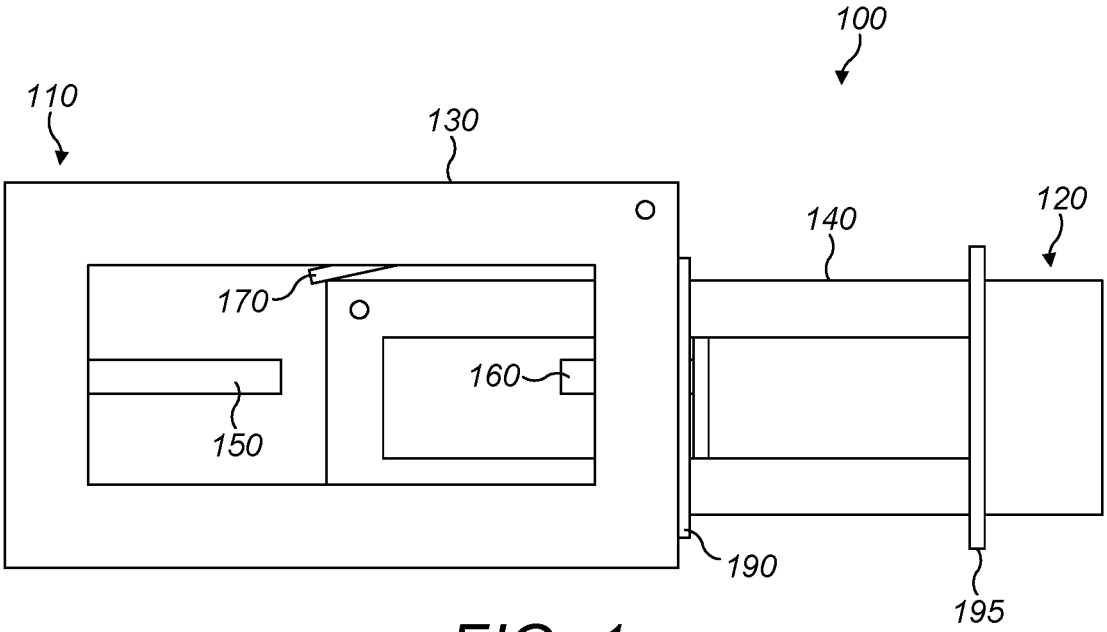
FIG. 1*c* is a schematic diagram showing the connector system of FIG. 1*a* in a second stage of connection according to an example.
Figure 1D:
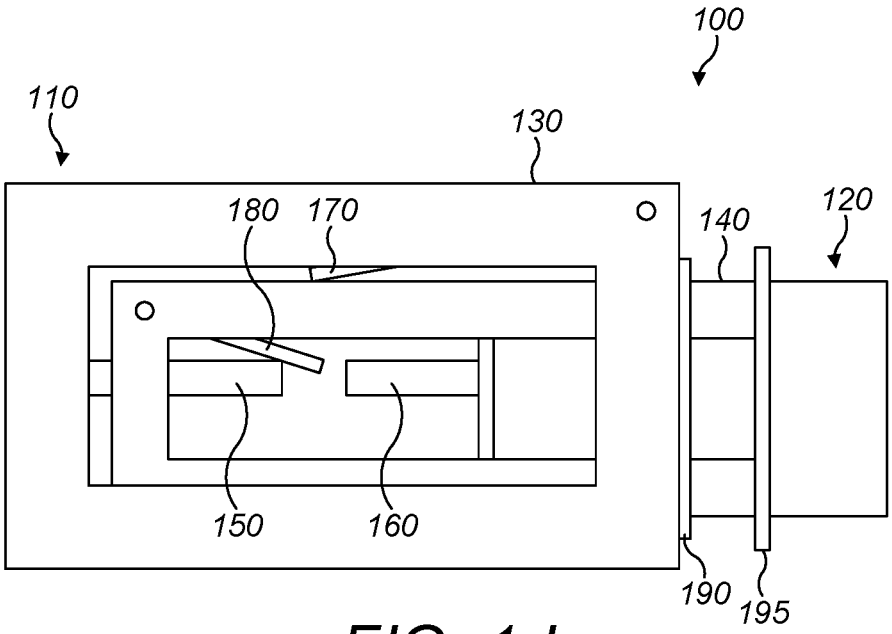
FIG. 1*d* is a schematic diagram showing the connector system of FIG. 1*a* in a third stage of connection according to an example.
Figure 1E:
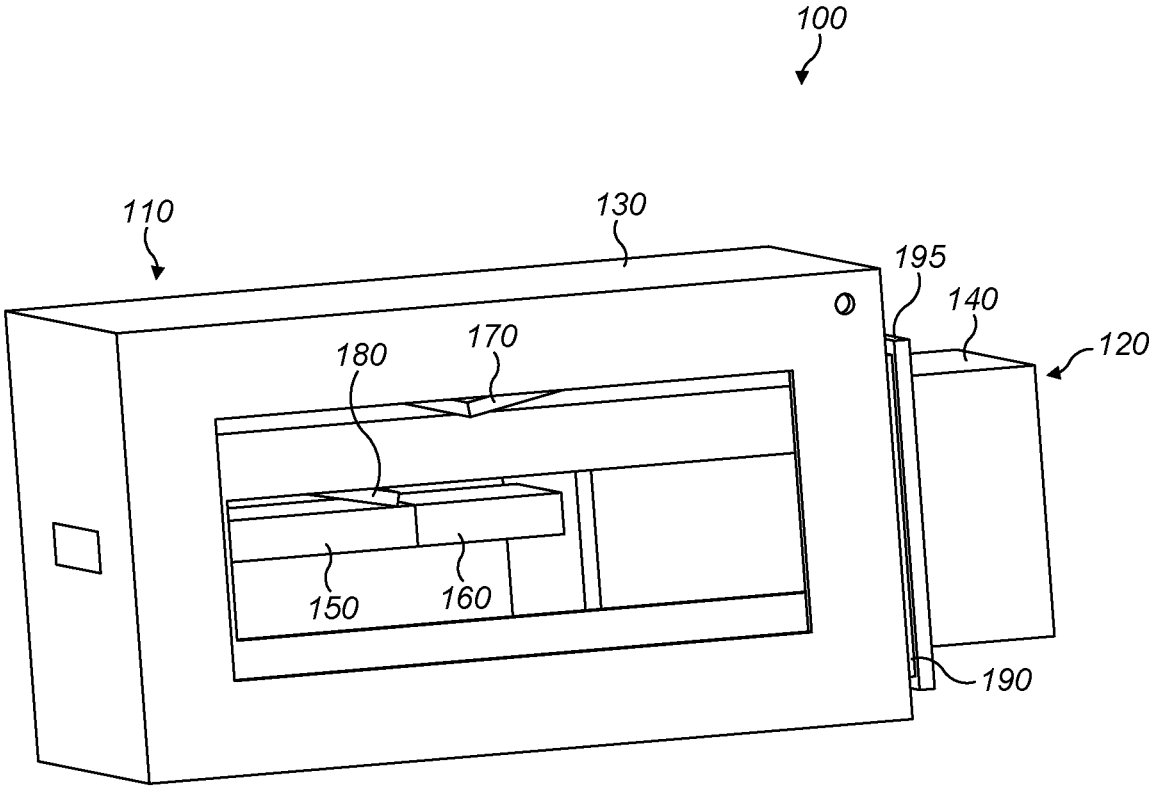
FIG. 1*e* is a schematic diagram showing the connector system of FIG. 1*a* in a connected state according to an example.

FIG. 1*c* illustrates the connection end of the first connector 120 partially inserted within the second housing 130. During insertion, the first connector 120 applies a force to the second cover 170 causing it to move from the closed position in which the second electrical contact 150 is inaccessible via the second opening to an open position in which the second electrical contact 150 is accessible via the second opening. The opening of the second cover 170 facilitates the continued insertion of the connection end of the first connector 120. At this point of insertion, the first cover 180 of the first connector 120 is still in the closed position isolating the first electrical contact 160 from particle ingress. FIG. 1*d* illustrates the connection end of the first connector 120 substantially inserted within the second housing 130. Following further insertion of the connection end of the first connector 120 within the second housing 130, the second electrical contact 150 applies a force to the first cover 180 causing it to move from the closed position in which the first electrical contact 160 is inaccessible via the first opening to an open position in which the first electrical contact 160 is accessible via the first opening. In an example, a part of the second housing 130, or a component within the second housing 130, may exert the force to cause the first cover 180 to move to the open position, to protect the second electrical contact 150 from wear resulting from multiple insertions and retractions of the first connector 120. FIG. 1*e* illustrates the connection end of the first connector 120 fully inserted within the second housing 130 such that the first electrical contact 160 is coupled with the second electrical contact 150, facilitating an electrical coupling between the first and second connectors. As the first electrical contact 160 is brought into contact with the second electrical contact 150, the sealing flange 195 on the first housing 140 engages with the seal 190 on the second housing 130 to isolate the internal cavity of the second housing 130 from the external environment. In some examples, the seal 190 and the sealing flange 195 may cooperate to provide an ingress protection level IP6 around the cavity within the second connector 110, completely preventing particle ingress. In an example, the seal 190 may be a gasket. The gasket may be made from rubber or any other suitable sealing material. In some examples, the seal may not be air-tight, but may provide filtering of particles from the air passing through the seal.

In some examples, the first cover and/or second cover may open away from the first and/or second housing to the open position. In other examples, the first cover and/or second cover may open into the first and/or second housing to the open position.

Figure 2C:
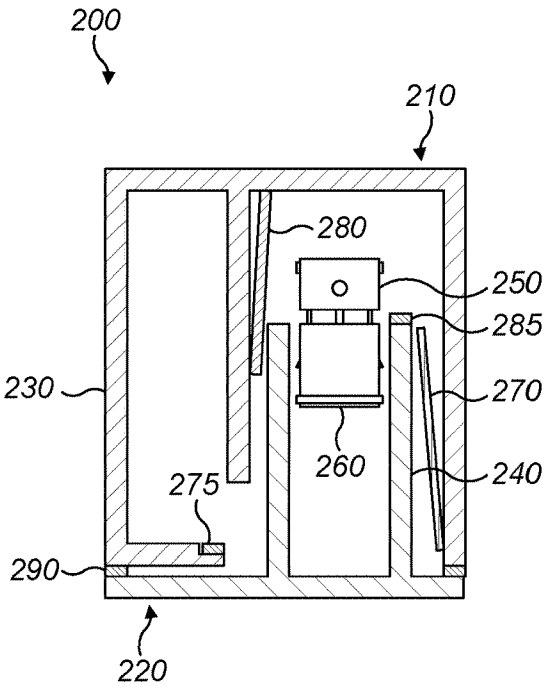
FIG. 2*c* is a schematic diagram showing the connector system of FIG. 2*a* in a connected state according to an example.
Figure 2B:
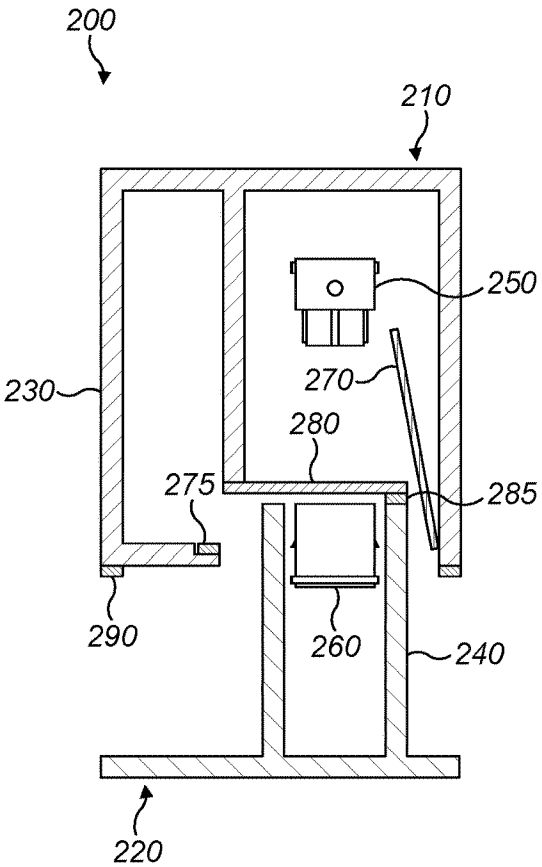
FIG. 2*b* is a schematic diagram showing the connector system of FIG. 2*a* in a first stage of connection according to an example.
Figure 2A:
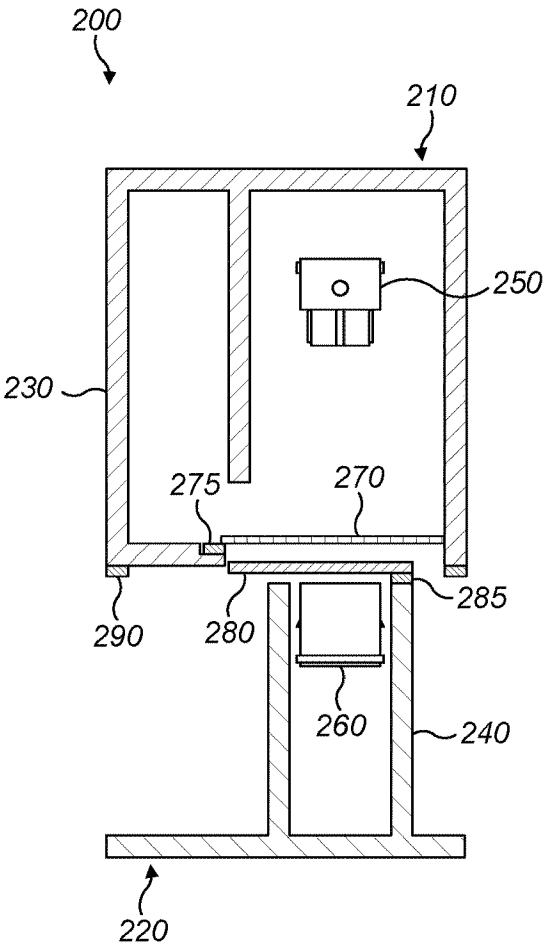
FIG. 2*a* is a schematic diagram showing an connector system according to an example in a disconnected state.

Referring to FIGS. 2*a-c*, there is shown an example of an electrical connection system 200. FIG. 2*a* shows a system 200 comprising a first connector 220 and a second connector 210 for receiving a connection end of the first connector 220. The first connector 220 comprises a first housing 240 having an internal cavity and a first opening at a connection end for insertion into a receiving connector. Covering the opening is a hinged door 280 with a biasing mechanism to bias the hinged door 280 against a seal 285 on the first housing 240 in a closed position to isolate the internal cavity in the first housing 240 from the external environment. Biasing the hinged door 280 against the seal 285 may prevent particle ingress into the cavity of the first housing 240 while the hinged door 280 is in the closed position. Contained within the first housing 240 is a first electrical contact 260. The first electrical contact 260 is shown as a female electrical contact for receiving a male electrical contact; however in other examples, any type of electrical contact, including a male electrical contact, may be present in the first housing. Provided on the first housing 240 is a sealing flange for engaging with a corresponding seal on a receiving connector.

The second connector 210 comprises a second housing 230 having an internal cavity and a second opening at a receiving end for receiving the first connector 220. Covering the second opening is a hinged door 270 with a biasing mechanism to bias the hinged door 270 against a seal 275 on the second housing 230 in a closed position to isolate the internal cavity in the second housing 230 from the external environment. Contained within the second housing 230 is a second electrical contact 250. The second electrical contact 250 is shown as a male electrical contact for insertion into a female electrical contact 260, however in other examples, a female electrical contact may be present. Provided on the second housing 230 around the second opening is a seal 290 for engaging with the sealing flange on the first connector 220 when the connection end of the first connector is inserted within the second opening of the second connector 210.

FIG. 2*a* illustrates the first connector 220 at a first stage of insertion into the second housing 230 of the second connector 210 in which the first connector 220 is in contact with, and applies a force against, the second hinged door 270 of the second connector 210. FIG. 2*b* illustrates first connector 220 at a second stage of insertion into the second housing 230 of the second connector 210 in which the first connector 220 has forced open the second hinged door 270 to become partially inserted within the second housing 230. In FIG. 2*b*, a strut in the second housing 230 abuts an extended portion of hinged door 280. As insertion of the first connector 220 within the second housing 230 continues, the strut in the second housing 230 applies a force against the hinged door 280, causing the hinged door 280 to pivot from the closed position to an open position in which the first electrical contact is accessible via the first opening. FIG. 2*c* illustrates how continued insertion of the first connector 220 within the second housing 230 results in the coupling of the first electrical contact 260 with the second electrical contact 250. As the first electrical contact 260 is brought into contact with the second electrical contact 250, the sealing flange on the first housing 240 engages with the seal 290 on the second housing 230 to isolate the internal cavity of the second housing 230, and the internal cavity of the first housing 220, from the external environment.

Figure 3:
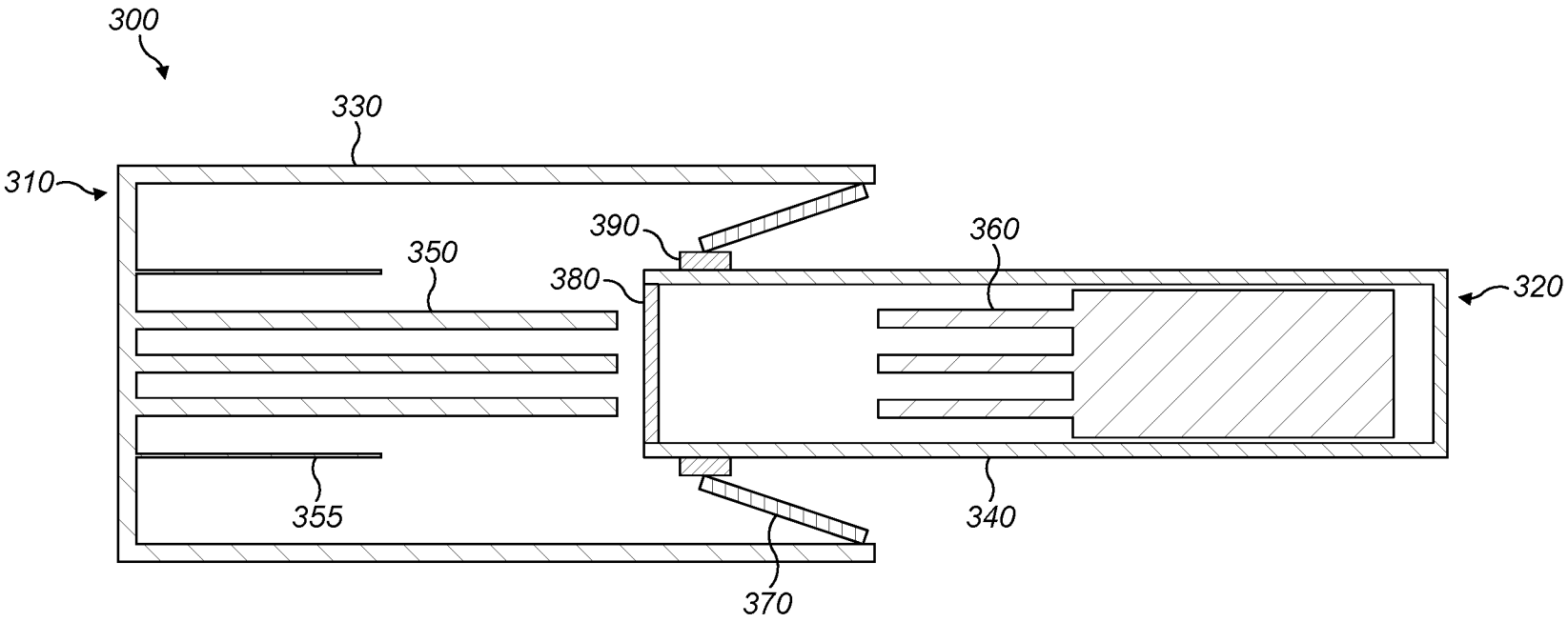
FIG. 3 is a schematic diagram showing a connector system according to an example during a first stage of connection.

FIG. 3 shows an example connector system 300 comprising a first connector 320 and a second connector 310 for receiving the first connector. The first connector 320 comprises a first housing 340 having an internal cavity and a first opening at a connection end for insertion into a receiving connector. Covering the first opening is a first cover 380 comprising a double hinged door arrangement, wherein each hinged door has a biasing mechanism to bias the respective hinged door towards a closed position to isolate the internal cavity in the first housing 340 from the external environment. Contained within the first housing 340 is a first electrical contact 360.

The second connector 310 comprises a second housing 330 having an internal cavity and a second opening at a receiving end for receiving the first connector 320. Covering the second opening is a second cover 370 comprising a double hinged door arrangement, wherein each door has a biasing mechanism to bias the hinged door towards a closed position to isolate the internal cavity in the second housing 330 from the external environment. In the illustrated example, sealing elements 390 are provided on end sections of the double hinged doors 370 to seal the internal cavity within the second housing 330 when the hinged doors 370 are in the closed position in which the sealing elements on each of the hinged doors 370 come into contact with each other. Contained within the second housing 330 is a second electrical contact 350, and a protrusion 355 for guiding the first housing 340 during insertion into the second housing 330, in order to ensure the correct engagement of the first and second electrical contacts 360, 350. In this example, when the connection end of the first housing 340 is inserted within the second housing 330, the two hinged doors 370 comprising the sealing elements are biased against the sides of the first housing 340. The double hinged doors 370 do not require as much lead space to facilitate the opening of the doors within the second housing 330 compared to the use of a single hinged door, enabling the use of receiving connectors 310 having smaller dimensions than are possible with a single hinged door arrangement.

In one example, the second cover 370 may be positioned within the cavity of the second housing 330, recessed from the second opening. In this example, the sides of the second housing 330 extending beyond the second cover 370 may provide a level of particle ingress protection during the opening of the second cover 370. In some examples, the connector system 300 may be configured to apply the force to move the first cover 380 to the open position before applying a force to move the second cover 370 to the open position during insertion of the connection end of the first housing into the second opening. In an example, this may be achieved by an arrangement including protruding elements on inner side walls of the second housing 330 extending beyond the second cover 370, and a double hinged door arrangement for the first cover 380 having portions of the double hinged doors 380 extending beyond the walls of the first housing 340 for engaging with the protruding elements on the second housing 330. In this case, as the connection end of the first housing 340 is inserted into the second opening, the protruding elements on the second housing 330 may engage with the extended portions of the double hinged doors 380 causing the double hinged doors 380 to pivot open. At a certain stage of insertion, the double hinged doors 380, in their open position, may connect with the second cover 370, exerting a force to cause the second cover 370 to open. In this arrangement, particle ingress may be further reduced during insertion of the first connector 320 because the first connector is already partially within the cavity of the second housing 330 by the time the second cover 370 is opened.

Figure 4:
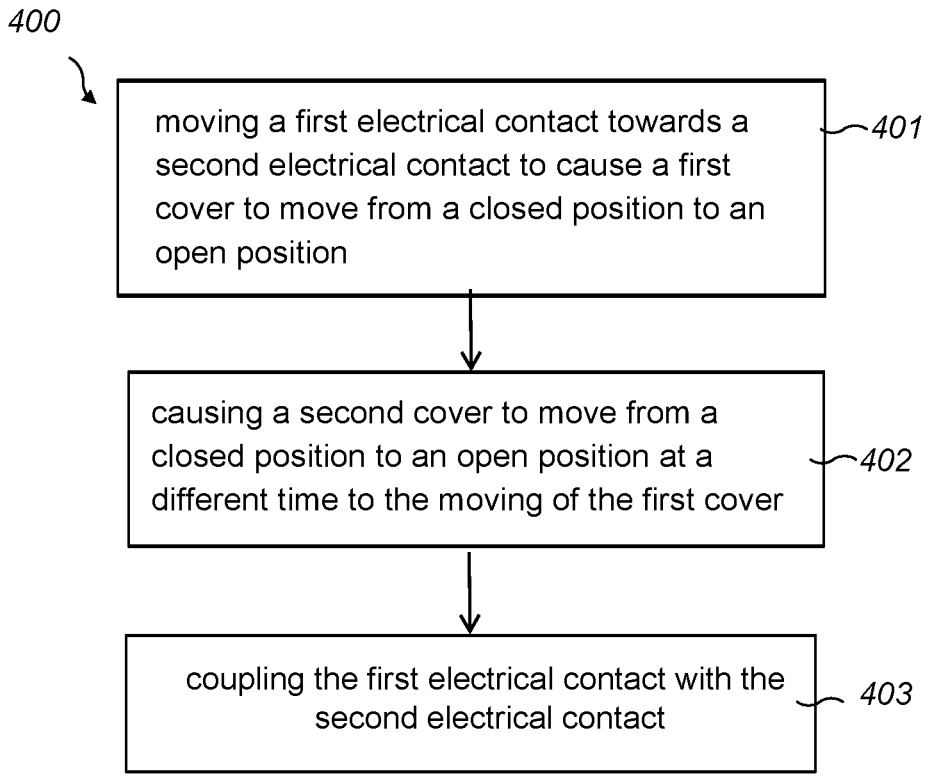
FIG. 4 shows a method for coupling two connectors according to an example.

FIG. 4 shows an example of a method 400 for coupling a first connector 120 with a second connector 110, wherein the first and second connectors are as shown in FIG. 1*a*. The method 400 comprises: moving 401 the first electrical contact 160 towards a second electrical contact 150 to cause the first cover 180 to move from the closed position to the open position; causing 402 a second cover 170 to move from the closed position to the open position at a different time to the moving of the first cover 180; and coupling 403 the first electrical contact 160 with the second electrical contact 150. The opening of the first and second covers of the two connectors at different times during the coupling of the two electrical contacts may restrict ingress of particles within the cavities of the first and second housings, thereby reducing the build-up of particles in the vicinity of the first and second electrical contacts. In an example, the connecting of the first connector 120 with the second connector 110 involves the linear movement of the first connector 120 relative to the second connector 110 to insert the first connector 120 within the second housing 130 to enable the coupling of the first electrical contact 160 with the second electrical contact 150. In addition to providing simplicity in the coupling of the two connectors, the use of linear movement of the connectors may improve the level of particle ingress protection by ensuring that the second cover 170 is opened only during the insertion of the connection end of the first connector 120 into the opening of the second housing, thereby blocking the second opening during the movement of the second cover from the closed position to an open position. This may provide improved particle ingress protection compared with an arrangement in which the second cover 170 is opened by the approach of a surface of the first connector 120 prior to the connection end of the first connector 120 passing through the second opening once the second cover 170 is already open.

Figure 5:
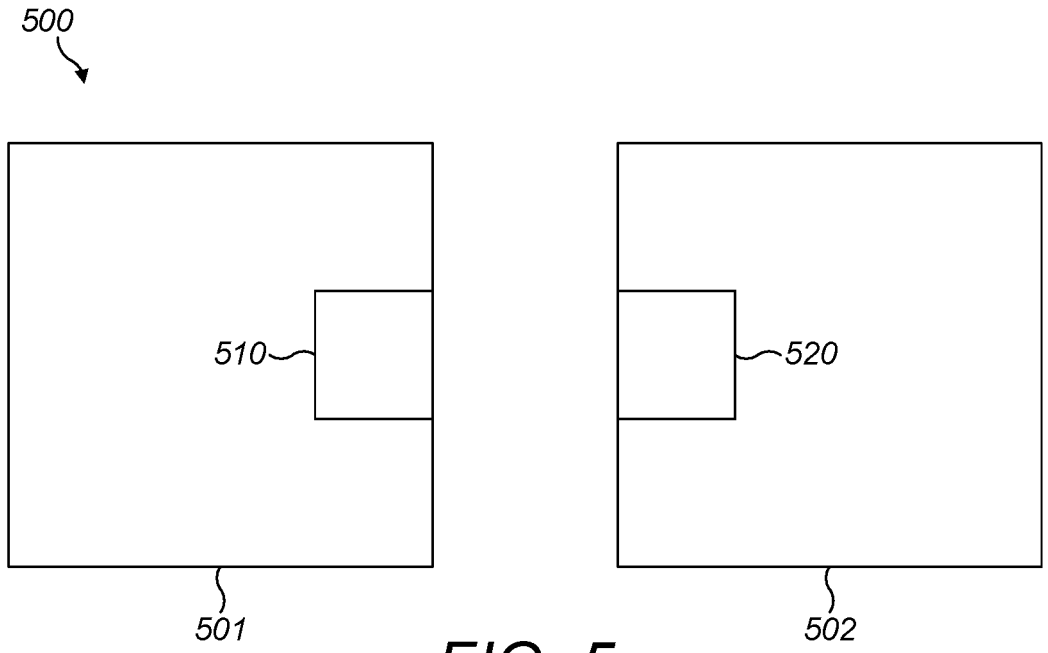
FIG. 5 is a schematic diagram of an additive manufacturing system comprising two components each having a connector, according to an example.

FIG. 5 shows an example of an additive manufacturing system 500 comprising an electrical connection system as described in any of the above examples. The additive manufacturing system comprises a component 501, such as a build unit, having the first/second connector 510 of any of the above described examples. In the example shown in FIG. 5, the additive manufacturing system further comprises an additional component 502, which may be a component such as a printing station or post-processing station, having the corresponding second/first connector 520. In an example, the additive manufacturing system may further comprise two additional components such as a printing station and post-processing station, each having the corresponding second/first connector. This example ensures that the electrical connector of the build unit is compatible with multiple stations, facilitating efficient transfer of the build unit between stations without the need for a connector adaptor which could jeopardise the ingress protection functionality of the connector system.

The invention claimed is:

1. An additive manufacturing system comprising:

a build unit having a first connector, wherein the first connector comprises:

a first housing having a connection end to be inserted into an opening of a second connector, the first housing containing a first electrical contact, wherein the connection end comprises a first opening, a first cover biased towards a closed position in which the first electrical contact is inaccessible via the first opening, wherein the first cover is movable from the closed position to an open position exposing the first electrical contact during insertion of the connection end into the opening of the second connector, and a sealing flange; and a printing station comprising a second connector, wherein the second connector comprises:

a second housing containing a second electrical contact within a cavity, the second housing comprising a second opening, a second cover biased toward a closed position in which the second electrical contact is inaccessible via the second opening and openable in response to an applied force during insertion of the connection end of the first housing into the second opening, wherein the opening of the first cover occurs at a different time to the opening of the second cover during insertion of the connection end of the first housing into the second opening, and a seal positioned such that when the first electrical contact is brought into contact with the second electrical contact, the seal engages with the sealing flange to prevent particle ingress into the cavity of the second housing.

2. The additive manufacturing system according to claim 1, wherein a part of the second housing provides a second force to open the first cover during insertion of the connection end into the second connector.

3. The additive manufacturing system according to claim 1, wherein the connection end is sized to fit flush with at least one of the second opening and an inner surface within the cavity of the second housing.

4. The additive manufacturing system according to claim 1, wherein the seal is positioned around the second opening of the second housing.

5. The additive manufacturing system according to claim 1, wherein the first cover is biased against a second seal on the first housing when the first cover is in the closed position.

6. The additive manufacturing system according to claim 1, wherein at least one of the first cover and the second cover comprises a hinged door with a spring to bias the door in the closed position.

7. The additive manufacturing system according to claim 1, wherein at least one of the first cover and the second cover comprises a pair of hinged doors with a pair of springs to bias the pair of doors in the closed position.

8. The additive manufacturing system according to claim 1, wherein the first housing and the first cover cooperate to provide a sealed internal cavity around the first electrical contact when the first cover is in the closed position.

9. The additive manufacturing system according to claim 1, wherein the second cover is biased against a second seal on the second housing when the second cover is in the closed position.

10. The additive manufacturing system according to claim 1, wherein the second cover is positioned within the cavity of the second housing, and wherein the second cover is spaced apart from the second opening.

11. The additive manufacturing system according to claim 7, wherein, during insertion of the connection end of the first housing into the second opening, the second housing applies a second force to move the first cover to the open position before the first housing applies the force to move the second cover to the open position.

12. An additive manufacturing system comprising:

a build unit having a first connector, wherein the first connector comprises:

a first housing having a connection end to be inserted into an opening of a receiving connector, the connection end containing a first electrical contact, wherein the connection end comprises a first opening, and a first cover biased toward a first closed position in which the first electrical contact is inaccessible via the first opening, wherein the first cover is moveable between the first closed position and a first open position exposing the first electrical contact; and a printing station having a second connector, wherein the second connector comprises:

a second housing containing a second electrical contact, the second housing comprising a second opening, and a second cover biased toward a second closed position in which the second electrical contact is inaccessible via the second opening, wherein, during insertion of the connection end into the second opening, the second cover opens at a first time in response to a first applied force, wherein, during insertion of the connection end into the second opening, the first cover opens at a second time subsequent to the first time in response to a second applied force, and wherein when the first electrical contact is coupled with the second electrical contact, a seal of the second housing engages with a sealing flange of the first housing to prevent particle ingress into a cavity of the second housing.

13. A method comprising:

moving a first electrical contact of a first housing toward a second electrical contact of a second housing, wherein the first housing is located in a build unit of an additive manufacturing system, wherein the first housing comprises a first cover biased toward a first closed position in which the first electrical contact is inaccessible via a first opening of the first housing, wherein the second housing is located in a printing station of the additive manufacturing system, and wherein the second housing comprises a second cover biased toward a second closed position in which the second electrical contact is inaccessible via a second opening of the second housing, causing, by the moving, the first cover to move from the first closed position to a first open position at a first time, wherein the first electrical contact is exposed in the first open position;

causing, by the moving, the second cover to move from the second closed position to a second open position at a second time subsequent to the first time; and coupling the first electrical contact with the second electrical contact, wherein when the first electrical contact is coupled with the second electrical contact, a seal of the second housing engages with a sealing flange of the first housing to prevent particle ingress into a cavity of the second housing.

* * * * *